US005553668A

United States Patent [19]

Council et al.

[11] Patent Number: 5,553,668

[45] Date of Patent: Sep. 10, 1996

[54] TWIN CARRIAGE TUBING INJECTOR APPARATUS

[75] Inventors: Malcolm N. Council, Richardson; Carl H. Johnson, Carrollton, both of Tex.

[73] Assignee: Halliburton Company, Duncan, Okla.

[21] Appl. No.: 508,411

[22] Filed: Jul. 28, 1995

[51] Int. Cl.[6] ..... E21B 19/22

[52] U.S. Cl. ..... 166/77.3; 166/85.1

[58] Field of Search ..... 166/77.3, 85.1, 166/85.5, 78

[56] References Cited

U.S. PATENT DOCUMENTS

| | | | |
|---|---|---|---|
| 3,285,485 | 11/1966 | Slator | 166/77.3 |
| 3,363,880 | 1/1968 | Blagg | 166/77.3 X |
| 3,559,905 | 2/1971 | Palynchuk | 166/77.3 X |
| 4,515,220 | 5/1985 | Sizer et al. | 166/384 |
| 4,585,061 | 4/1986 | Lyons, Jr. et al. | 166/77.3 |
| 4,655,291 | 4/1987 | Cox | 166/385 |
| 4,899,823 | 2/1990 | Cobb et al. | 166/77.3 X |
| 5,002,130 | 3/1991 | Laky | 166/77.3 X |
| 5,088,559 | 2/1992 | Taliaferro | 166/379 |
| 5,094,340 | 3/1992 | Avakov | 198/626.1 |
| 5,133,405 | 7/1992 | Elliston | 166/77.3 X |
| 5,188,174 | 2/1993 | Anderson, Jr. et al. | 166/77.3 |
| 5,234,053 | 8/1993 | Connell | 166/250 |
| 5,244,046 | 9/1993 | Council et al. | 166/380 |
| 5,309,990 | 5/1994 | Lance | 166/77.3 |

OTHER PUBLICATIONS

Otis Engineering Corporation Products and Services Catalog, 1989, pp. 284–290.

Photographs 1, 2, 3, and 4 of a prior art apparatus.

*Primary Examiner*—Frank Tsay

*Attorney, Agent, or Firm*—Stephen R. Christian; Neal R. Kennedy

[57] ABSTRACT

A twin carriage coiled tubing injector apparatus for use in inserting coiled tubing into a well, temporarily suspending the coiled tubing, and removing the tubing from the well. The apparatus includes a superstructure with a pair of spaced carriages disposed therein. The carriages each have a gripper chain drive system rotatably mounted thereon and movable therewith. An actuation and linkage system allows the carriage to be moved toward and away from one another in a transverse direction with respect to the superstructure. This movement allows gripper chain systems to be engaged or disengaged from tubing extending through the apparatus. A roller chain system is disposed in each of the carriages and is adapted for engagement and support of the gripper chain systems as the gripper chain systems are engaged with the tubing. A timing gear system may optionally be provided to insure that the rotational speed of the gripper chain systems are substantially constant.

20 Claims, 5 Drawing Sheets

TWIN CARRIAGE TUBING INJECTOR APPARATUS

BACKGROUND OF THE INVENTION

1. Field Of The Invention

This invention relates to an injector apparatus having endless gripper chains and endless roller chains for inserting and removing coiled tubing into and out of subterranean wellbores such as those used in the production of oil and gas. More particularly, the disclosed invention relates to coiled tubing injectors having the ability to easily and quickly accommodate the passage of tools and wellhead equipment having large nominal diameters through the injector while the injector remains installed about the wellhead.

2. Description Of The Prior Art

After a well has been completed to produce oil or gas, it is necessary to periodically service the well. There are many occasions where the service procedure is carried out using coiled tubing. Such tubing is inserted into the wellhead through a lubricator assembly or stuffing box. Typically, this is necessary because there is a pressure differential at the surface of the well and the atmosphere, which may have been naturally or artificially created, that serves to produce oil or gas or a mixture thereof from the pressurized well. The tubing that is inserted into the well is normally inserted through a lubricator mechanism which provides a seal about the O.D. of the tubing for the retention of any pressure that may be present at or near the surface of the well. The tubing is inserted by an injector which generally incorporates a tubing guide, or gooseneck, and a multitude of gripper blocks for handling the tubing as it passes through the injector. The tubing is relatively flexible and can therefore be cyclically coiled onto and off of a spool, or reel, by the injector which often acts in concert with a windlass and a power supply which drives the spool, or reel. One such exemplary injector is the Otis Reeled Tubing Injector. The injector utilizes a pair of opposed endless drive chains which are arranged in a common plane. These opposed endless drive chains are often referred to as gripper chains because each chain has a multitude of gripper blocks attached therealong. The gripper chains are driven by respective drive sprockets which are in turn powered by a reversible hydraulic motor. Each gripper chain is also provided with a respective idler sprocket to maintain each gripper chain within the common plane. Both the drive sprockets and idler sprockets are mounted on a common frame wherein the distance between the centers of all the sprockets are essentially of a constant distance from each other. That is the drive sprockets are free to rotate but are not free to move either vertically or laterally with respect to each other and the idler sprockets are not free to move laterally with respect to each other, but are vertically adjustable within a limited amount in order to set the amount of play in each gripper chain. Such vertical adjustment is done by either a mechanical adjusting means or a hydraulic adjusting means. Typically, the adjustment is made when the injector is not in operation.

The opposed gripper chains, preferably via the gripper blocks, sequentially grasp the coiled tubing that is positioned between the opposed gripper chains. When the gripper chains are in motion, each chain has a gripper block that is coming into contact with the coiled tubing as another gripper block on the same gripper chain is breaking contact with the coiled tubing. This continues in an endless fashion as the gripper chains are driven to force the tubing into or out of the wellbore, depending on the direction in which the drive sprockets are rotated. Preferably, gripper blocks such as those set forth in U.S. Pat. No. 5,094,340, issued Mar. 10, 1992 to Avakov, which is incorporated herein, are used.

Because the gripper chain drive sprockets and idler sprockets are essentially in a fixed relationship with each other, the gripper chain is provided with a predetermined amount of slack which allows the gripper chain to be biased against the coiled tubing to inject the tubing into and out of the wellbore. This biasing is accomplished with a endless roller chain disposed inside each gripper chain, and each roller chain being driven by sprockets rotatably mounted on a respective linear bearing beam. A linkage and hydraulic cylinder mechanism allows the linear bearing beams to be moved toward one another so that each roller chain is moved against its corresponding gripper chain such that the tubing facing portion of gripper chain is moved toward the tubing so that the gripper blocks can engage the tubing and move it through the apparatus.

The fixed distance between each set of gripper chain drives and idler sprockets requires some significant lateral movement in the gripper chain when engaged by the roller chain on the corresponding linear beam in order to allow the gripper chains to engage the tubing by way of the gripper blocks. The reason for having the requisite amount of lateral play in the gripper chains is to provide a limited amount of clearance between the gripper chains, upon moving the respective roller chains away from the vertical center line of the injector, to allow the passage of tubing and tools having larger outside diameters or dimensions. An inherent shortcoming in this design is that the required slack can often cause misalignment problems and even binding problems with the chains due to having to accommodate ever increasing outside nominal dimensions of downhole tools and wellhead equipment. Another troublesome characteristic manifests itself in the large approach and departure angles de:fined by the region where the respective paths of the gripper chains converge upon, and diverge away from, the working center line of the injector wherein the coiled tubing is preferably positioned for being injected or extracted into or out of the well. The large approach and departure angles reduce the overall efficiency of the injector by causing increased friction due to the longer chains that must be used and the necessity of supporting and contending with the reactive forces generated by the chains when the injector is in operation.

A further, if not more predominate reason why large gripper chain approach and departure angles are not desired, is that large angles tend to increase the likelihood of the chain-mounted gripper blocks to mark, or gouge, the tubing as the blocks come into contact with the tubing. Such marks, or gouges, create stress risers within the wall of the tubing which can lead to premature structural failure of the tubing. Therefore, a tubing injector apparatus not having large gripper chain approach or departure angles, yet being able to accommodate large diameter tubing and wellhead equipment would advance the art considerably.

Therefore there is a need within the art to provide an injector that, while the injector remains installed about the wellhead, can accommodate large nominal diameter tools and surface equipment, yet can provide efficient and reliable chain operation to generate the high forces needed for injecting and extracting tubing of long lengths and large diameters into and out of the wellbore.

Another need within the art is for an injector having the ability to accommodate a wide range of tubing diameters while in operation. Such an injector would allow for improving operations wherein coiled tubing having differing diameters that have been connected to each other to form a single string of tubing are being used in the servicing of the well.

Another need within the art is for an injector that can accommodate the ever increasing nominal outside diameters of tubing while avoiding: chain mis-alignment, chain binding tendencies, improper chain tension, increased chain friction caused by excessively long gripper chains, gripper block marking or gouging, and other inherent design problems of prior injectors which manifest themselves when working with tubing, tools, and surface equipment having large nominal outside diameters.

These and other needs are fulfilled by the present invention of the injector apparatus disclosed herein.

SUMMARY OF THE INVENTION

The present invention is a tubing injector apparatus for use in inserting coiled tubing into a well, temporarily suspending the tubing in the well, and for extracting the coiled tubing from the well. The apparatus generally comprises a superstructure, at least one carriage substructure preferably disposed partially within the superstructure and extending partially therefrom, and a gripper chain drive system mounted on the at least one carriage substructure. The carriage substructure is transversely movable with respect to the superstructure. The gripper chain drive system is thus movable with the carriage substructure and is adapted for engaging tubing along a preselected centerline axis extending through the superstructure when the at least one carriage substructure is moved toward the tubing. Preferably, the carriage substructure is one of a pair of such carriage substructures which are transversely movable with respect to one another such that the tubing may be disposed therebetween.

The gripper chain drive system comprises a drive shaft rotatably mounted on the carriage substructure, a drive sprocket mounted on the drive shaft, an idler shaft rotatably mounted on the carriage substructure, an idler sprocket mounted on the idler shaft, and a gripper chain having tubing engaging blocks attached thereto. The gripper chain is engaged with the drive and idler sprockets such that, as the drive sprocket is rotated, the gripper chain is correspondingly moved. This movement of the gripper chain will cause movement of the tubing through the superstructure in an upward or downward direction depending upon the rotation of the gripper chain.

The apparatus also comprises a roller chain system adapted for engagement with the gripper chain for supporting the gripper chain when engaged with the tubing. The roller chain system is mounted on a linear beam rigidly positioned in the carriage substructure. The roller chain system comprises an upper mounting shaft mounted on the linear beam, a first roller sprocket mounted on the upper mounting shaft, a lower mounting shaft mounted on the linear beam, a second roller sprocket mounted on the lower mounting shaft, and a roller chain engaged with the first and second roller sprockets.

The apparatus also comprises an alternative timing gear system engaged with the drive shaft of each of the gripper chain drive systems such that the rotational speed thereof is maintained in a substantially constant relationship.

Numerous objects and advantages of the invention will become apparent as the detailed description of the preferred embodiment is read in conjunction with the drawings which illustrate such embodiment.

DESCRIPTION OF THE PREFERRED EMBODIMENT

Figure 1:
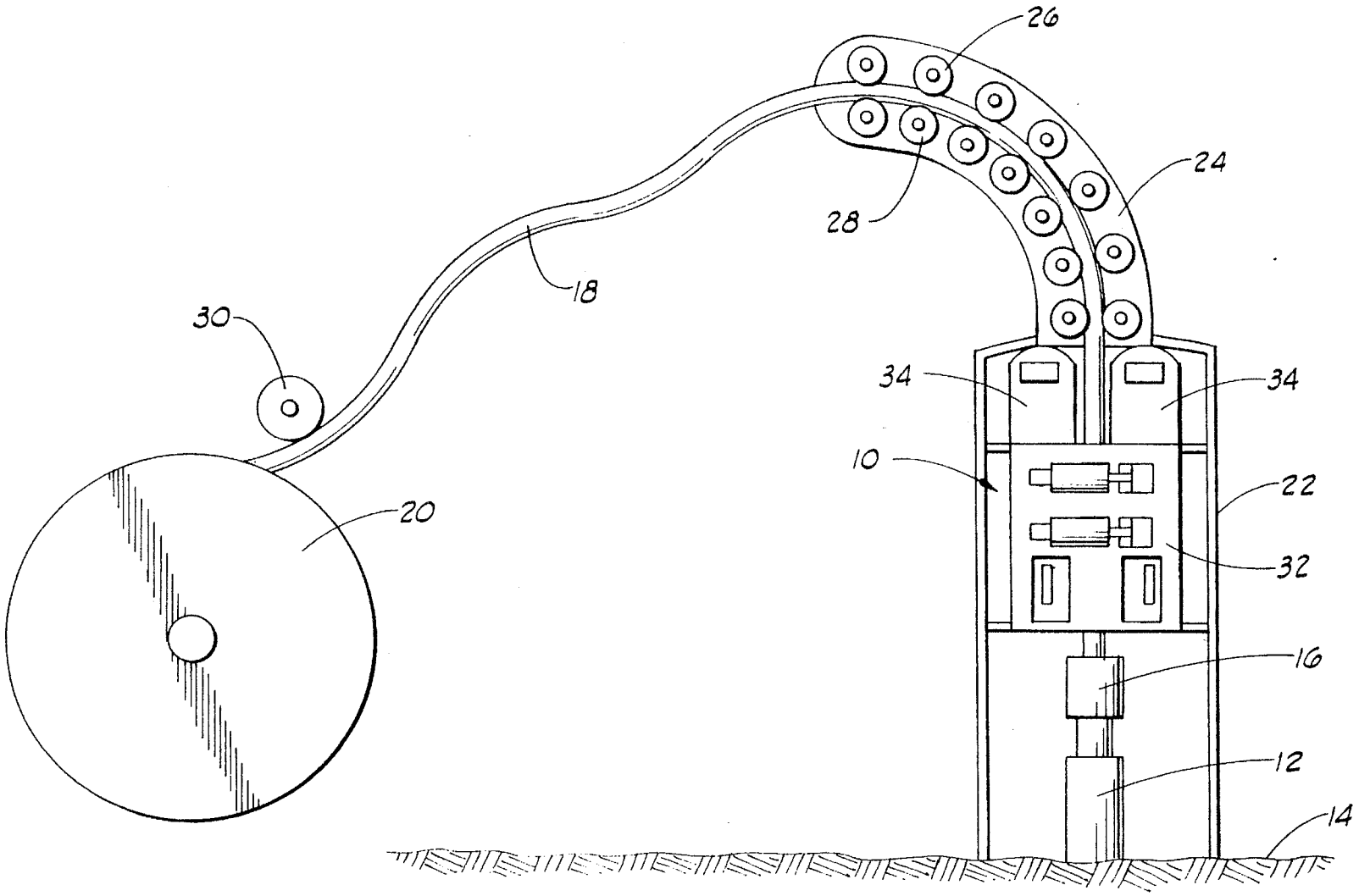
FIG. 1 schematically shows the preferred twin carriage tubing injector apparatus of the present invention in position for inserting coiled tubing into an adjacent wellhead.

Referring now to the drawings, and more particularly to FIG. 1, the twin carriage tubing injector apparatus of the present invention is shown and generally designated by the numeral 10. Injector 10 is shown positioned above a wellhead 12 at a ground surface or subsea floor 14. A lubricator or stuffing box 16 is connected to the upper end of wellhead 12.

Tubing 18 is supplied on a large drum or reel 20 and is typically several thousand feet in length. Tubing of sufficient length, such as 10,000 feet or greater, may be inserted into the well either as single tubing, or as tubing spliced by connectors or by welding. The outer diameters of the tubing can range from approximately one inch (2.5 cm) to approximately 5 inches (12.5 cm). However, the disclosed injector apparatus is readily adaptable to even larger diameters. Typically, tubing 18 is in a relaxed but coiled state when supplied from drum 20. It is spooled from the drum typically supported on a truck (not shown) for mobile operations.

Injector apparatus 10 is mounted above wellhead 12 on a superstructure 22. Extending upwardly from superstructure 22 is a guide framework 24 having a plurality of pairs of guide rollers 26 and 28 rotatably mounted thereon.

Tubing 18 is supplied from drum 20 and is run between rollers 26 and 28. As tubing 18 is unspooled from drum 20, generally it will pass adjacent to a measuring device, such as wheel 30. Alternatively, the measuring device may be incorporated in apparatus 10, such as described in U.S. Pat. No. 5,234,053, issued Aug. 10, 1993 to Connell.

Rollers 26 and 28 define a pathway for tubing 18 so that the curvature in the tubing is slowly straightened as it enters apparatus 10. As will be understood, tubing 18 is preferably formed of a material which is sufficiently flexible and ductile that it can be curved for storage on drum 20 and also later straightened. While the material is flexible and ductile, and will accept bending around a radius of curvature, it runs the risk of being pinched or suffer from fatigue failure should the curvature be severe. Rollers 26 and 28 are spaced such that straightening of the tube is accomplished wherein the tubing is inserted into the well without kinks or undue bending on the tubing. However, the disclosed injector can be used for injecting, suspending, or extracting any generally elongated body. All of this is done in a manner known in the art.

Figure 2:
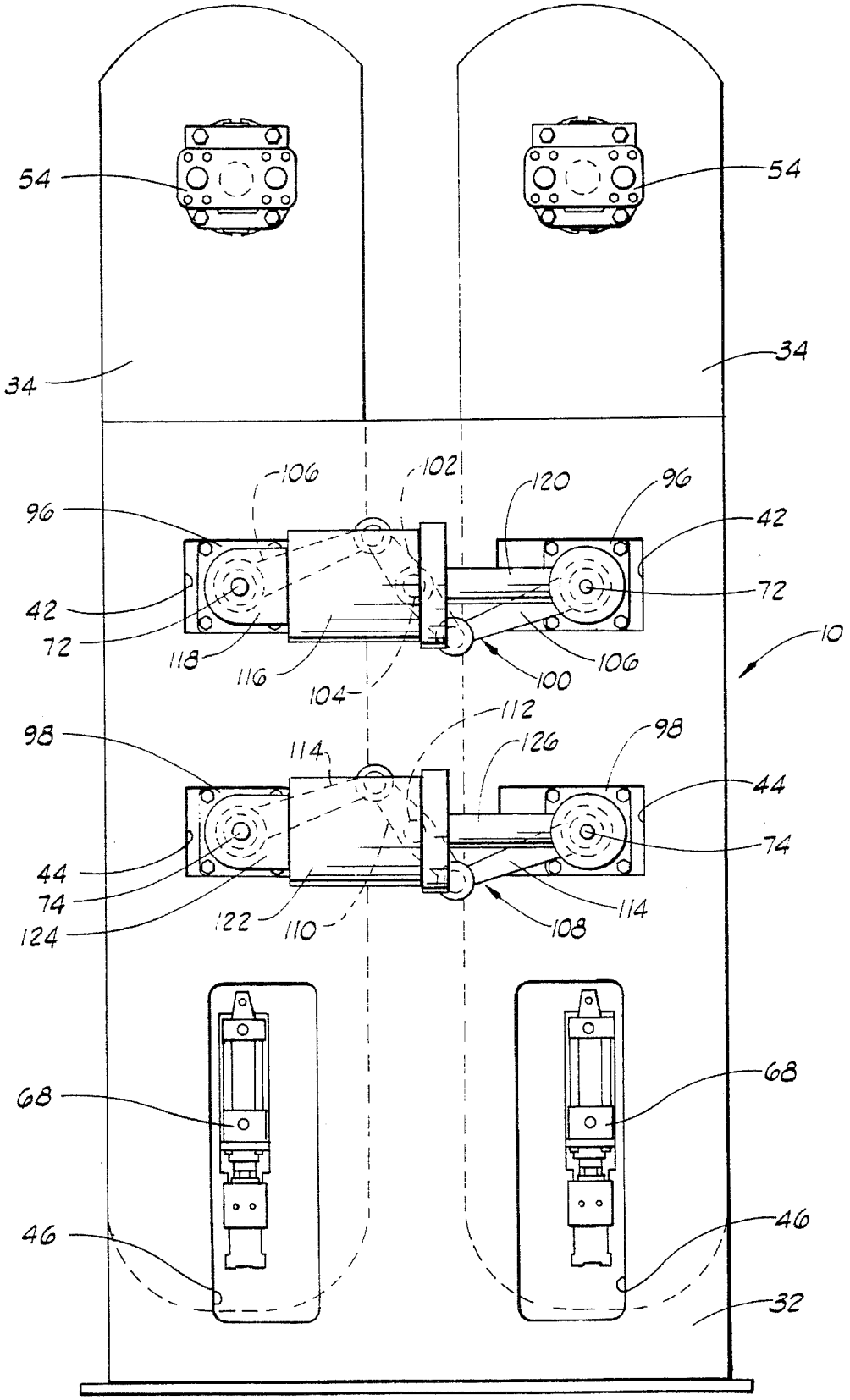
FIG. 2 shows a front view of the superstructure and substructure of the tubing injector apparatus.
Figure 3:
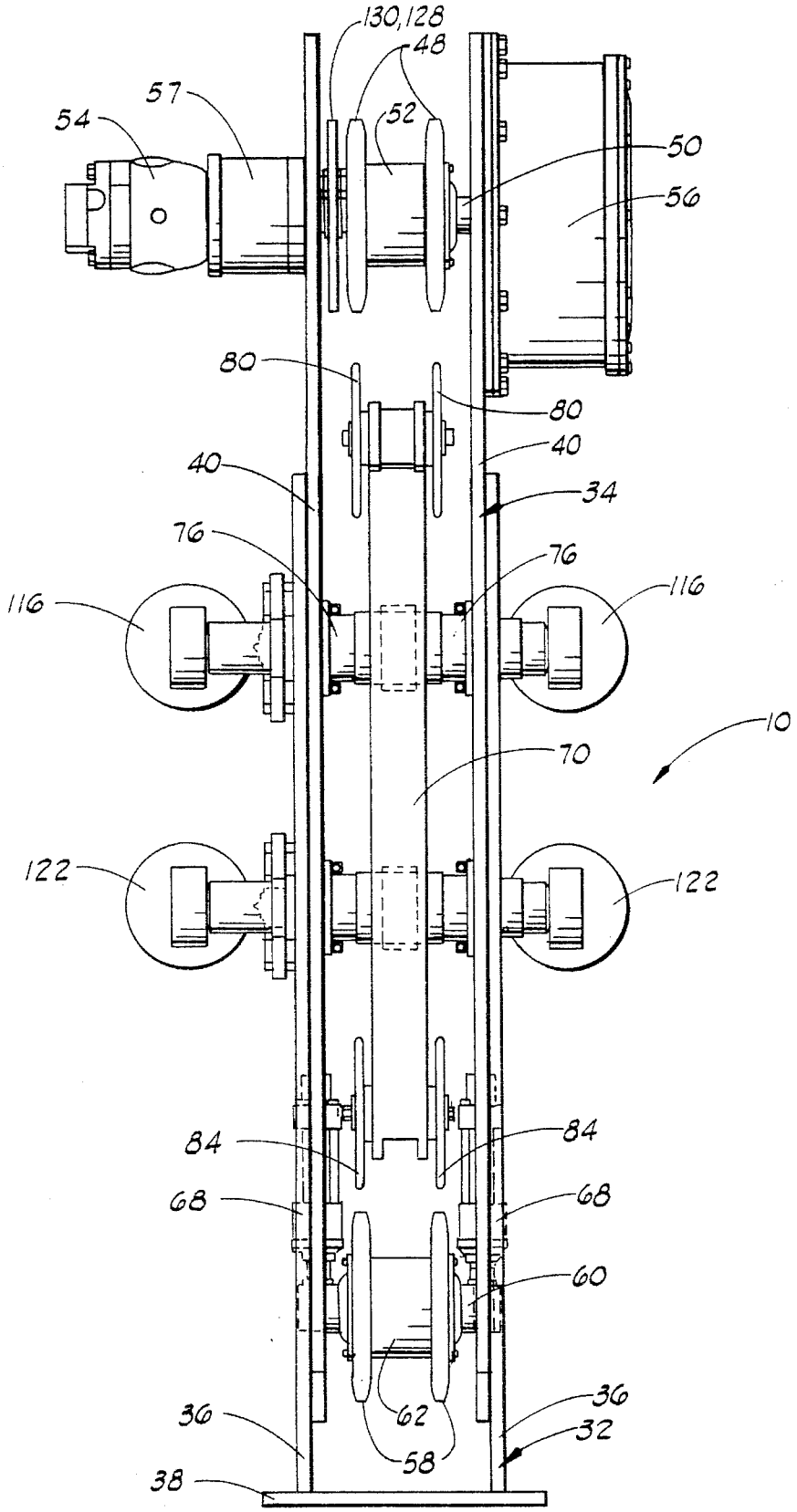
FIG. 3 is a side view of the apparatus.
Figure 4:
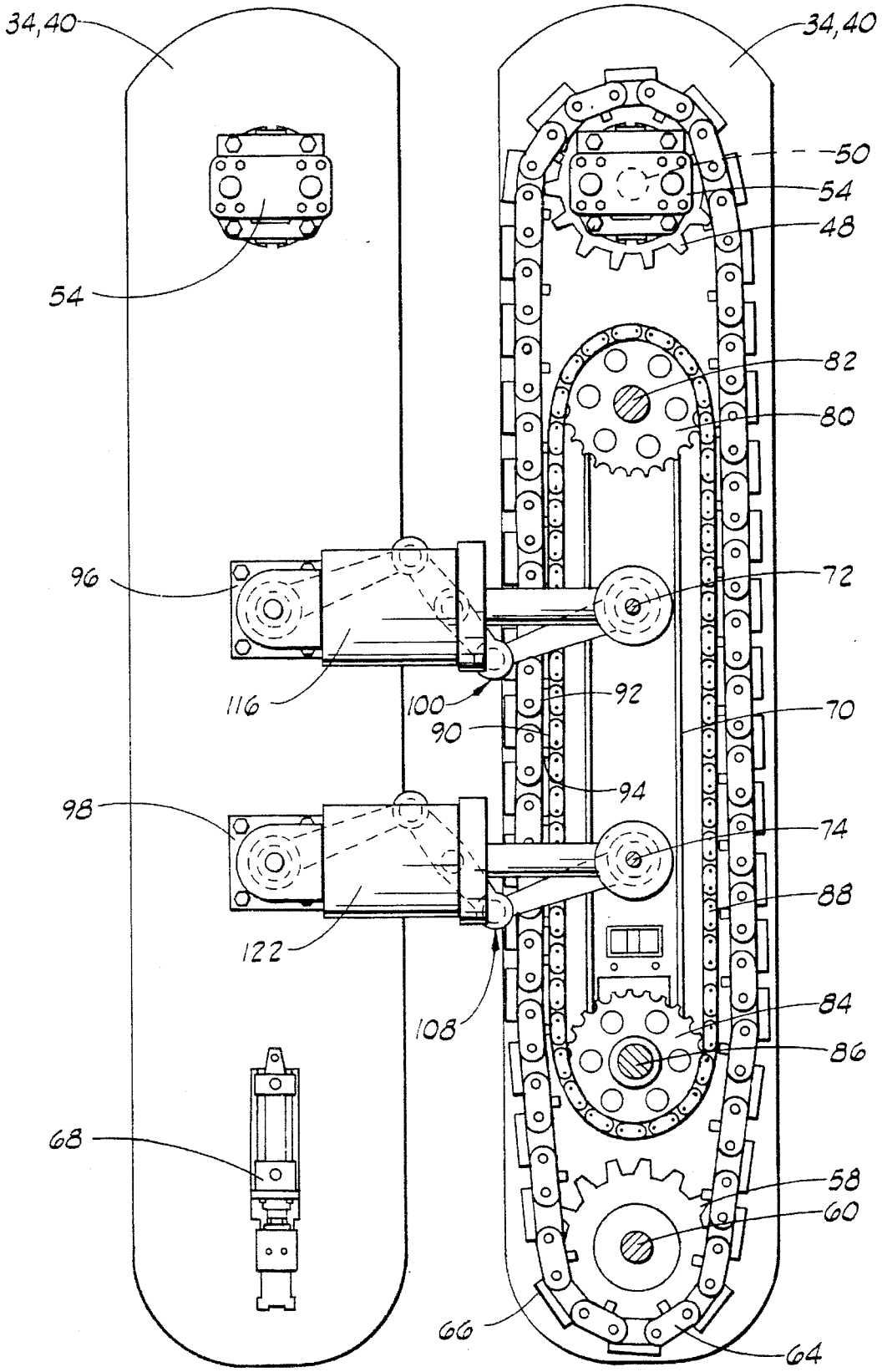
FIG. 4 is a partial front view and a partial cross-section view showing the twin carriages with the superstructure removed.

Referring now to FIGS. 2–4, details of injector apparatus 10 will be discussed. Apparatus 10 generally comprises a superstructure 32 and a pair of substantially identical carriage substructures, or inner frames, 34. Superstructure frame 32 includes a pair of spaced outer plates 36 and a base 38.

Each carriage 34 includes a pair of spaced inner plates 40. Carriages 34 are positioned longitudinally within superstructure 32 and extend partially upwardly therefrom. Carriages 34 are adapted for movement toward one another in a transverse direction within superstructure 32.

Outer plates 36 of superstructure 32 define a pair of upper openings 42 therethrough and a substantially similar pair of intermediate openings 44 therethrough. Below intermediate openings 44 are a pair of longitudinally oriented lower openings 46 defined through superstructure 32.

Referring now to FIGS. 3 and 4, a spaced pair of gripper chain drive sprockets 48 are rotatably disposed within the upper end of each carriage 34. Drive sprockets 48 are mounted on a shaft 50 and have a spacer 52 disposed therebetween. Drive sprockets 48 are driven by a hydraulic motor 54 through a planetary gear set 56 in a manner known in the art. A brake 57 is provided to stop rotation and hold drive sprockets 48 in a stationary position when desired.

A pair of spaced gripper chain idler sprockets 58 are rotatably disposed in the lower end of each carriage 34. Idler sprockets 58 are mounted on a shaft 60 and have a spacer 62 therebetween.

As best seen in FIG. 4, a gripper chain 64 is engaged with the pair of upper gripper chain drive sprockets 48 and the corresponding pair of lower gripper chain idler sprockets 58 in each carriage 34. Gripper chain 64 is of a kind known in the art and has a plurality of outwardly facing tubing gripper blocks 66 thereon. As will be further discussed herein, gripper blocks 66 are adapted for engaging coiled tubing 18 and moving it through apparatus 10.

A gripper chain tensioner 68 is connected to the opposite ends of shaft 60 on which gripper chain idler sprockets 58 are mounted. Tensioners 68 are connected to the corresponding adjacent inner plate 40 of inner frame 34 and bias idler sprockets 58 downwardly to keep the proper tension on gripper chain 64 in a manner known in the art. As seen in FIG. 2, tensioners 68 extend through lower openings 46 in superstructure 32. The length of lower openings 46 is sufficient to allow vertical movement and adjustment of tensioners 68.

Referring again to FIGS. 3 and 4, an elongated linear beam 70 is disposed between inner plates 40 of each carriage 34. An upper mounting shaft 72 and a lower mounting shaft 74, which are vertically spaced from one another, extend through linear beam 70 and the facing inner plates 40. Upper mounting shaft 72 is rotatably mounted in a pair of upper shaft adapters 76. Similarly, lower mounting shaft 74 is rotatably disposed in a pair of lower shaft adapters 78. An upper shaft adapter 76 and a lower shaft adapter 78 are disposed on opposite sides of linear beam 70. Upper and lower shaft adapters 76 and 78 are rigidly connected to linear beam 70 and inner plates 40. Thus, linear beam 70 is rigidly positioned with respect to carriage 34.

An upper or first roller chain sprocket 80 is rotatably disposed on each side of the upper end of linear beam 70. Chain sprockets 80 are mounted on a shaft 82. A lower or second roller chain sprocket 84 is rotatably disposed on each side of the lower end of linear beam 70. Chain sprockets 84 are mounted on a shaft 86. A roller chain 88 is engaged with upper roller chain sprockets 80 and lower roller chain sprockets 84. An outer side 90 of roller chain 88 is adapted for engagement with an inner side 92 of gripper chain 64 along a line generally indicated by numeral 94. Lower roller chain sprockets 84 incorporate a tensioner (not shown) of a kind known in the art to keep the proper tension on roller chain 88.

Preferably, sprockets 48, 58, 80, and 84 are, to such an extent as is practical, vertically aligned to minimize the amount of the approach and departure angles between gripper chain 94 and tubing 18.

Referring now to FIGS. 2 and 4, the outer ends of upper mounting shaft 72 extend through upper shaft supports 96 which are rigidly attached to the outside of the corresponding inner plate 40 of carriage 34. Similarly, the outer ends of lower mounting shaft 74 extend through lower shaft supports 98 which are also rigidly attached to the outside of the corresponding inner plate 40. As seen in FIG. 2, upper shaft supports 96 extend at least partially into upper openings 42 in superstructure 32, and lower shaft supports 98 extend at least partially into intermediate openings 44 in superstructure 32.

An upper equalizer linkage 100 interconnects adjacent upper mounting shafts 72 on each side of superstructure 32. Upper equalizer linkage 100 includes a central link 102 which is pivotally mounted on a pivot pin 104 attached to superstructure 32. A pair of outer links 106 interconnect the ends of central link 102 with a corresponding upper mounting shaft 72.

A similar lower equalizer linkage 108 is used to interconnect lower mounting shafts 74. Lower equalizer linkage 108 includes a central link 110 pivotally connected to superstructure 32 by pivot pin 112 and also having outer links 114 which connect the ends of central link 110 with a corresponding lower mounting shaft 74.

A hydraulically actuated upper gripper cylinder 116 is positioned beside each outer plate 36 of superstructure 32 generally adjacent to upper openings 42. Upper gripper cylinder 116 has a flange 118 which is connected to one of upper mounting shafts 72 and a plunger 120 attached to the other upper mounting shaft 72. This connection of upper gripper cylinder 116 to upper mounting shafts 72 is in such a way that upper mounting shafts 72 are still free to rotate.

A similar lower gripper cylinder 122 has a flange 124 and a plunger 126 which are connected to the ends of the pair of lower mounting shafts 74. Each lower gripper cylinder 122 is positioned beside an outer plate 36 of superstructure 32 and generally adjacent to intermediate openings 44 in the superstructure.

OPERATION OF THE INVENTION

In operation, coiled tubing 18 is fed downwardly as previously described between adjacent carriages 34 and into lubricator 16 as best seen in FIG. 1. By actuating upper gripper cylinder 116 and lower gripper cylinder 122 to retract plungers 120 and 126, respectively, upper mounting shafts 72 are moved inwardly toward one another. Those skilled in the art will see that upper equalizer linkage 100 will thus cause upper mounting shafts 72 to be moved a substantially equal distance toward one another with respect to a vertical center line through tubing 18. Because upper mounting shafts 72 and 74 extend through carriages 34, it also will be seen that the carriages will be moved toward one another a substantially equal amount with respect to superstructure 32. This causes gripper blocks 66 on each gripper chain 64 to engagingly contact tubing 18. The portion of gripper chain adjacent to the tubing is supported on its inner side by roller chain 88 along line 94 as previously mentioned. However, other means of providing support to gripper chain 64 can be used that are known these skilled in the art.

Actuation of motors 54 will cause the right-hand side gripper chain 64 to rotate in a counterclockwise direction as seen in FIG. 4. The other gripper chain will turn in a clockwise direction so that both gripper chains act to move tubing 18 downwardly.

When it is desired to move gripper chain 64 out of engagement with tubing 18, upper and lower gripper cylinders 116 and 122 are actuated to extend plunger 120 and 126 to move inner carriages 34 apart and thus disengage the gripper chains. This can be done with or without stopping the rotation thereof by deactivation of motors 54.

It will be understood by those skilled in the art that alternative linkage arrangements including chain drive cams, levers, and gear driven linkage may be employed as well as the employment of alternative types or number of hydraulic cylinders or other apparatus for biasing the carriages toward and away from each other.

Upper openings 42 in superstructure 32 are sized such that transverse movement of upper shaft supports 96 are allowed while preventing any significant vertical movement thereof. Similarly, intermediate window 44 is sized to allow transverse movement of lower shaft supports 98 while preventing any significant vertical movement thereof. Thus, carriages 34 are provided with purely transverse movement upon actuation of upper and lower gripper cylinders 116 and 122.

ALTERNATE EMBODIMENT

In the original embodiment previously described, the rotation of gripper chains 64, as controlled by actuation of hydraulic motors 54, is not deemed critical. That is, it is not generally necessary to insure that the gripper chains are moving at exactly the same speed, and control thereof with motors 54 is generally sufficient. However, there may be occasions when timing of the two gripper chains 64 would be desirable.

Figure 5:
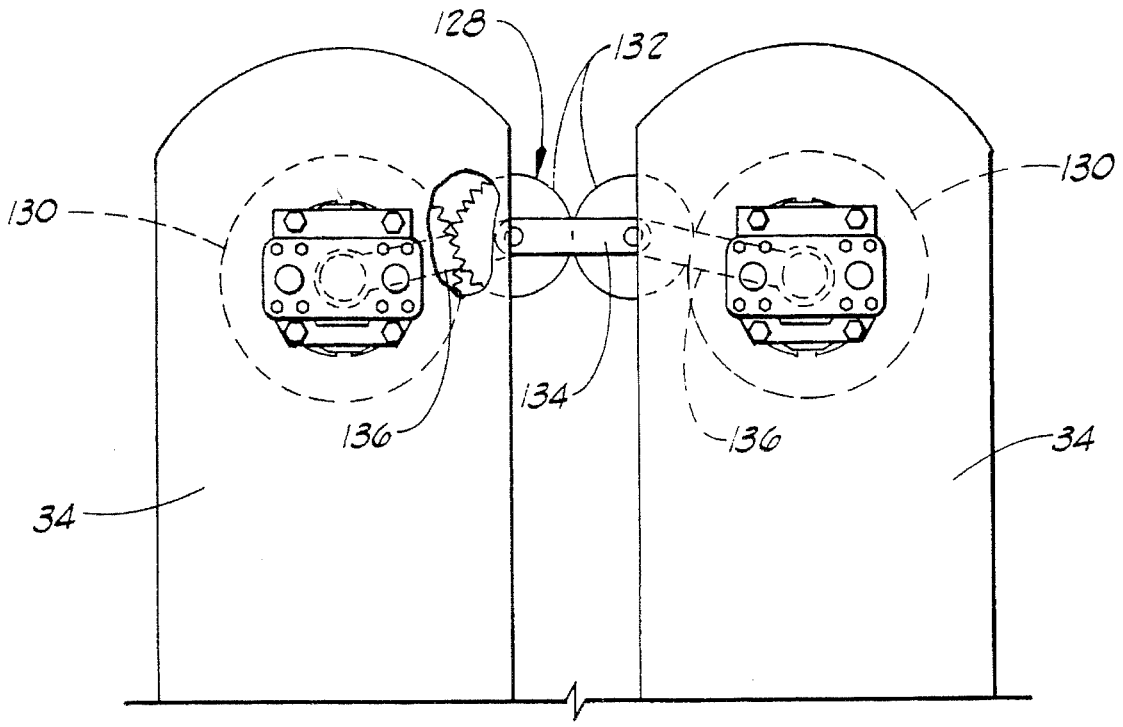
FIG. 5 shows an alternate embodiment of the preferred injector apparatus having a set of linked timing gears.

The alternate embodiment shown in FIG. 5 illustrates a timing gear train 128. Gear train 128 includes a pair of main gears 130, each main gear 130 being mounted on drive shaft 50. This feature is also shown in FIG. 3. A pair of timing gears 132 interact with one another and with main gears 130 to insure that the rotational speeds of shafts 50 are substantially identical.

Figure 6:
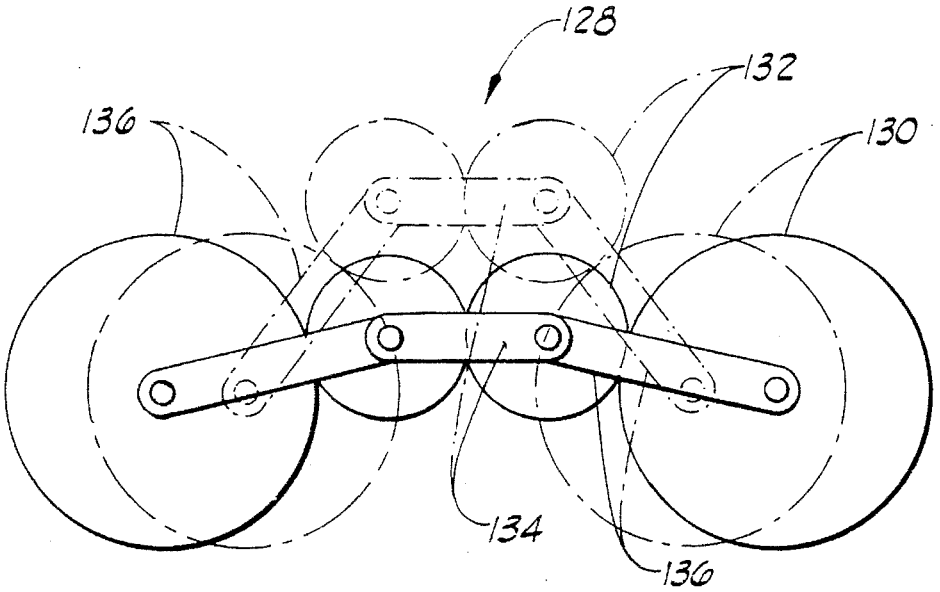
FIG. 6 is a positional schematic view illustrating different positions of the linked timing gears.

A central link 134 interconnects timing gears 132, and an outer link 136 interconnects each timing gear 132 with the adjacent main gear 130. FIG. 6 illustrates the movement of main gears 130 and timing gears 132 as main gears 130 are moved toward one another as carriages 32 are moved. An outer position of main gears 130 is shown in solid lines in FIG. 6, and an inner position of main gears 130 is shown in phantom lines in FIG. 6. Central link 132 and outer links 136 keep all of the gears interconnected regardless of the relative position between the central axes of main gears 130.

It will be seen, therefore, that the twin carriage tubing injector apparatus of the present invention is well adapted to carry out the ends and advantages mentioned, as well as those inherent therein. While presently preferred embodiments of the apparatus have been shown for the purposes of this disclosure, numerous changes in the arrangement and construction of parts may be made by those skilled in the art. All such changes are encompassed within the scope and spirit of the appended claims.

What is claimed is:

1. A coiled tubing injector apparatus comprising:

a superstructure;

a carriage substructure mounted to the superstructure, the carriage being transversely movable with respect to the superstructure; and a gripper chain drive system mounted on the carriage substructure and movable therewith, the gripper chain drive system being adapted for engaging coiled tubing extending through the superstructure when the carriage substructure is moved toward the tubing.

2. The apparatus of claim 1 wherein the carriage substructure is one of a pair of carriages positioned such that the tubing may be disposed therebetween.

3. The apparatus of claim 1 wherein the gripper chain drive system comprises:

a drive shaft rotatably mounted on the carriage substructure;

a drive sprocket mounted on the drive shaft;

an idler shaft rotatably mounted on the carriage substructure;

an idler sprocket mounted on the idler shaft; and a gripper chain having tubing engaging blocks attached thereto and engaged with the drive and idler sprockets whereby, as the drive sprocket is rotated, the gripper chain is moved, thereby moving the tubing through the superstructure.

4. The apparatus of claim 3 further comprising a roller chain system adapted for engagement with the gripper chain for supporting the gripper chain when the gripper chain is engaged with the tubing.

5. The apparatus of claim 4 wherein the roller chain system is mounted on the carriage substructure.

6. The apparatus of claim 4 wherein the roller chain system is mounted on a linear beam rigidly positioned in the carriage substructure.

7. The apparatus of claim 6 wherein the roller chain system comprises:

an upper mounting shaft mounted on the linear beam;

a first roller sprocket mounted on the upper mounting shaft;

a lower mounting shaft mounted on the linear beam;

a second roller sprocket mounted on the lower mounting shaft; and a roller chain engaged with the roller sprockets.

8. The apparatus of claim 3 wherein the carriage substructure is one of a pair of spaced carriages movable toward one another, each having a gripper chain system thereon.

9. The apparatus of claim 3 further comprising a timing gear system engaged with the drive shaft of each gripper chain drive system such that the rotational speed thereof is maintained substantially constant.

10. A coiled tubing injector apparatus comprising:

a superstructure;

a pair of spaced carriages disposed in the superstructure, the carriages being transversely movable toward one another with respect to the superstructure and positioned so that tubing may be disposed therebetween;

a gripper chain drive system disposed in at least one of the carriages and movable therewith such that the gripper chain drive systems may be engaged on opposite sides of tubing disposed between the carriages.

11. The apparatus of claim 10 further comprising actuating means for moving the carriages relative to one another.

12. The apparatus of claim 11 further comprising equalizer linkage engaged with the carriages such that the carriages are moved substantially the same distance when the actuating means is actuated.

13. The apparatus of claim 10 wherein each gripper chain drive system comprises:

a drive sprocket rotatably mounted on the corresponding carriage;

an idler sprocket rotatably mounted on the corresponding carriage; and a gripper chain engaged with the drive and idler sprockets and driven by the drive sprocket, the gripper chain having tubing gripper blocks attached thereto adapted for engagement with the tubing and moving the tubing through the superstructure as the gripper chain is rotated.

14. The apparatus of claim 13 further comprising a roller chain system disposed in at least one of the carriages and adapted for engagement with the corresponding gripper chain when the gripper chains are engaged with the tubing.

15. The apparatus of claim 14 further comprising:

a linear beam positioned in at least one of the carriages;

wherein, one of the roller chain systems is mounted on at least one of the linear beams.

16. The apparatus of claim 15 wherein at least one of the roller chain systems comprises:

an upper mounting shaft mounted on the corresponding linear beam;

a lower mounting shaft mounted on the corresponding linear beam;

roller sprockets attached to each of the upper and lower mounting shafts; and a roller chain engaged with the roller sprockets.

17. The apparatus of claim 10 further comprising a timing gear system engaged with the gripper chain drive systems such that the rotational speed thereof is maintained substantially constant.

18. The apparatus of claim 17 wherein the timing gear system comprises:

a pair of main gears, each of the main gears being rotatable with a corresponding one of the gripper chain drive systems; and a pair of timing gears, each of the timing gears being engaged with one of the main gears and with the other of the timing gears.

19. The apparatus of claim 18 further comprising linkage interconnecting the main gears and timing gears such that the main gears and timing gears are maintained in engagement regardless of the relative position of the carriages.

20. The apparatus of claim 10 wherein:

the superstructure comprises a pair of spaced outer plates; and the carriages each comprise a pair of inner plates, the inner plates being disposed between the outer plates.

* * * * *